United States Patent [19]

Franks

[11] 3,958,144

[45] May 18, 1976

[54] SPARK PLUG

[76] Inventor: Harry E. Franks, 60 Beacon St., Chestnut Hill, Mass. 02167

[22] Filed: Nov. 22, 1974

[21] Appl. No.: 526,402

Related U.S. Application Data

[63] Continuation of Ser. No. 402,485, Oct. 1, 1973, abandoned, and a continuation-in-part of Ser. No. 242,608, May 22, 1972.

[52] U.S. Cl. ..... 313/138; 313/118; 313/141; 313/143; 29/182

[51] Int. Cl.² ..... H01T 13/20

[58] Field of Search ..... 313/118, 138, 141–143, 313/141.1; 123/169 R, 169 EL; 29/182

[56] References Cited

UNITED STATES PATENTS

| | | | |
|---|---|---|---|
| 1,312,317 | 8/1919 | Gerken | 313/141 |
| 2,071,645 | 2/1937 | McNeil | 123/169 EL |
| 2,143,853 | 1/1939 | Armstrong et al. | 313/141 |
| 2,217,825 | 10/1940 | Twinning et al. | 313/141.1 X |
| 2,470,033 | 5/1949 | Hensel | 313/142 |
| 3,356,882 | 12/1967 | Hallauer et al. | 313/141 |

*Primary Examiner*—John Kominski
*Attorney, Agent, or Firm*—James J. Cannon, Jr.

[57] ABSTRACT

Spark plugs having electrodes formed from combinations in defined proportions of tungsten, vanadium, depleted uranium, rhodium, iridium, palladium, nickel, chromium, copper, barium aluminate, iron, and thoria. Various advantageous electrode configurations are described, as well as methods of constructing the spark plugs.

2 Claims, 11 Drawing Figures

SPARK PLUG

This is a continuation of application Ser. No. 402,485, filed Oct. 1, 1973 and now abandoned.

This application is a continuation-in-part of application ser. No. 242,608, filed May 22, 1972.

BACKGROUND

1. Field of the Invention

This invention relates to spark plugs, and more particularly to materials for spark plug electrodes and configurations thereof.

2. Description of the Prior Art

Several problems have been encountered with heretofore known spark plugs that substantially reduce the life of the plug and require relatively frequent replacement under normal wear. One of these problems involves carbonization and the depositing of lead, lead oxide, and other contaminants in and around the electrodes during the course of repeated electrical discharges. Such phenomena alter the dimensions of the spark gap and reduce the effectiveness of the spark to the point where the plugs must be either cleaned or replaced, and in addition contribute to the pollutants emitted from the engine in which the plug is used.

Another problem is that of pitting and general physical deterioration of the electrodes after a certain period of operation. Pitting increases the effective spark gap, thereby increasing the electrical potential needed for dishcarge. It results in weak sparks and ultimately failure to spark when required.

BRIEF SUMMARY OF THE INVENTION

It is an object of the present invention to provide a novel and improved spark plug. Another object is the provision of a novel and improved spark plug having an extended life time. A further object is the provision of a spark plug having improved pitting and physical deterioration characteristics. Still another object is the provision of a novel and improved spark plug accumulating a low level of contaminating deposits on the electrodes during operation.

In the accomplishment of the above objects, a spark plug is provided with electrodes formed from alloys that produce a sparking operation considerably improved over that attained with heretofore employed materials. Specifically, the electrodes are each comprised about 60 to 99.9% from one of the materials in the group consisting of tungsten, vanadium, depleted uranium, rhodium, iridium, and palladium, and 0.1 to about 40% from one or more of the materials in the group consisting of chromium, copper, barium aluminate, iron, thoria, and nickel. Improved results are also obtained when an electrode is comprised about 60 to 99.9% from nickel and 0.1 to about 40% from one or more of the materials in the group consisting of copper, barium aluminate, iron, thoria, and chromium in combination with one or more of the last four mentioned materials. In a preferred embodiment the cathode is comprised 0.1 to about 40% from barium aluminate, and the anode is comprised 0.1 to about 40% from one or more of the materials in the group consisting of chromium, copper and nickel.

Various electrode geometrical configurations are also included, in all of which substantially planar sparking surfaces are mutually opposed in parallel to provide a large number of alternate sparking paths. In one configuration the electrodes are generally coaxial, the outer electrode including a plurality of spaced perforations that contribute to the gaseous turbulence in the sparking chamber and hence to the distribution of the spark into the chamber, and also serve to enhance heat dispersion. In one embodiment at least some of the perforations are spaced backward from the forward end of the electrode to establish gas flow paths through the spark gap generally coaxial with the plug. In another embodiment an improved economy of materials is achieved by providing generally elongated cylindrical electrode mounting bases, with the electrodes deposited at the forward ends of the mounting bases as thin layers of electrode material. The outer mounting base in this embodiment includes a plurality of spaced perforations comprising gas flow passageways. Another embodiment includes as one electrode an annular member, the forward edge of which is sloped inwardly, and a preferably conical mounting member for the second electrode having a side wall generally parallel to the sloped edge of the first electrode. The second electrode is formed from a layer of electrode material deposited on the side wall of the mounting member in mutual parallelism with the sloped forward edge of the first electrode, the axial position of the mounting member preferably being adjustable to enable adjustment of the spark gap. In a further embodiment a mounting base is provided for the first electrode that comprises a ring and a plurality of bendable fingers extending conically forward therefrom. The second electrode has a generally conical mounting base with a side wall generally parallel to the said fingers. The electrodes are deposited in mutual opposition on opposed surfaces of the fingers and preferably conical mounting base, adjustments in the dimension of the spark gap being facilitated by bending the mounting fingers.

The invention also comprehends methods of constructing spark plugs having the material characteristics described above. According to one method the electrodes are admixed in powder form and compressed and heated, preferably simultaneously, to the desired dimensions and densities. In another method the electrode materials are melted in a gaseous plasma, which is then projected out selected portions of the spark plug to coat the said portions with a layer of electrode material.

Other objects, features, and advantages will occur to one skilled in the art from the following description of particular embodiments of the invention taken together with the attached drawings thereof, in which.

DETAILED DESCRIPTION OF THE INVENTION

Figure 1:
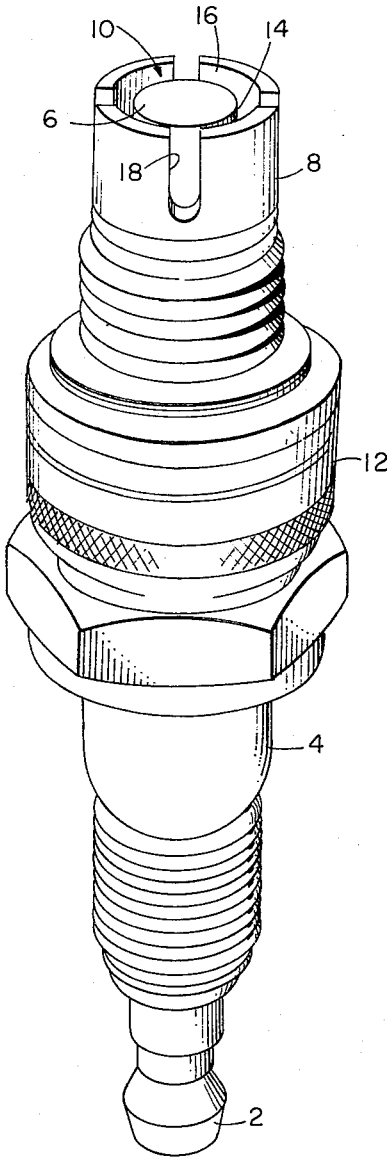
FIG. 1 is a perspective view of a spark plug constructed in accordance with the present invention.

Referring to FIG. 1, a spark plug is shown constructed in accordance with the present invention. A terminal 2 formed from an electrically conductive material is seated in a body 4 formed from a nonconductive material such as ceramic. The terminal 2 is connected to an internal conductor (not shown) that extends longitudinally through the body 4 and carries a cylindrical electrode 6 at the forward end of the spark plug that serves as an anode. Electrode 6 is coaxially encircled by an outer electrode 8, with an annular spark gap 10 defined between the two electrodes. Outer electrode 8 is electrically connected to a conventional threaded mounting shank 12 for mounting the plug in a cylinder, and forms an electrical ground. The mutually opposed planar surfaces 14 and 16 of electrodes 6 and 8 are substantially parallel, the outer electrode 8 including a plurality of slots 18 open at their forward ends to enable radial gas flow between the spark gap 10 and the exterior of electrode 8.

It has been discovered that a considerably superior performance and longer life is achieved with spark plugs such as that described above when the electrodes are formed from certain alloys composed of materials selected from two groups. Specifically, the electrodes in the spark plugs comprehended by my invention are formed from alloys comprised about 60 to 99.9% from one of the materials in a first group consisting of tungsten, vanadium, depleted uranium, rhodium, iridium, and palladium, and 0.1 to about 40% from one or more of the materials in a second group consisting of chromium, copper, barium aluminate, iron, thoria, and nickel. (Depleted uranium has a low $\mu$-235 content, for example about 0.23 as opposed to about 0.71% in natural uranium, and is generally available as a by-product of gaseous diffusion operations employed in the production of enriched feed material for nuclear reactor fuel.) Electrodes constructed from the above materials have been found to be subject to a greatly reduced amount of carbonization and physical deterioration under prolonged use, and are very stable in the level of firing voltage required. A somewhat lesser but still much improved wear is obtained when the electrodes are comprised about 60 to 99.9% from nickel and 0.1 to about 40% from one or more of the materials in the group consisting of copper, barium aluminate, iron, thoria, and chromium combined with one or more of the last four mentioned materials.

It may be preferrable to construct the two electrodes from different alloys for certain applications. A generally improved performance has resulted, for example, when the outer cathode electrode 8 contains barium aluminate as the component from the second group, while the inner anode electrode 6 contains either chromium, copper, nickel, or a combination thereof.

In a series of tests performed on a set of identical spark plugs constructed in accordance with the present invention with the configuration shown in FIG. 1, the plugs were run in a first car for 17,868 miles and then transferred to a second car for an additional run of 13,800 miles. The electrodes each comprised 90% tungsten, 7% copper, and 3% nickel. The spark plugs were inspected after 5,000 and 10,000 miles in the second car, a 1968 Chevrolet with a 327 cubic inch engine having run 74,280 miles at the beginning of the test. Very little carbonization and physical deterioration were found, and no increase in the firing voltage was required. After 13,800 miles in the second car more carbonization was evident, the firing voltage having remained stable.

A second set of spark plugs had electrodes comprising about 75% nickel, 15% chromium, 5% iron, and copper for the remainder. They were run successfully for a total of about 30,000 miles in various cars, and showed little sign of wear at the end of the test.

It is believed that the geometric configuration of the electrodes in the above spark plugs contributed to their durability. Should pitting occur, the spark path between the pitted portion of the electrode surface and the opposite electrode surface increases in length. This should cause the sparks to shift to other portions of the electrodes which are not pitted and thus provide shorter sparking paths. The shifting action can continue for a long period of time before the effective sparking path between the parallel planar electrodes is increased significantly.

FIGS. 2–11 illustrate various other electrode configurations that may be used to enhance the sparking characteristics. It is generally preferred in these embodiments that the center electrode extended slightly forward of the outer electrode, further away from the mounting body, so as to project the spark into the combustion chamber. The various perforations to be described in the outer electrode cause a turbulence in the gas adjacent the electrodes during sparking and assist in propogating the sparks into the combustion chamber. The perforations also control the heat level at which the spark plug operates; large, evenly distributed perforations enhance heat loss and cause the plug to run cool, while small or zero perforations result in hot operation. The reference numerals employed in FIG. 1 are carried over to these drawings where features are repeated from FIG. 1.

Figure 2:
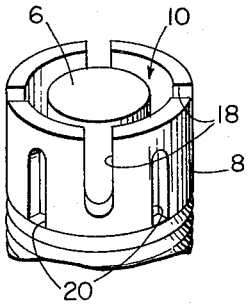
FIGS. 2–8 are fragmentary perspective views of various electrode configurations within the scope of the invention.

In FIG. 2, in addition to the slots 18 in the outer electrode 8, a plurality of slots 20 are provided in the outer electrode 8 and spaced backward from the forward end of the electrode. A gas flow path generally co-axial with the spark plug is thereby established from each slot 20, through the spark gap 10, to the forward end of the plug to increase the extension of the sparks into the combustion chamber.

Figure 3:
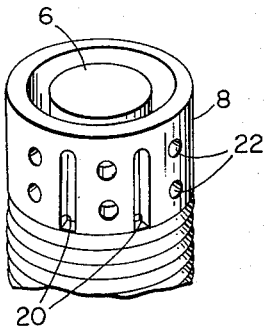
Figure 4:
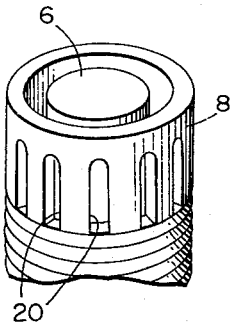
Figure 5:
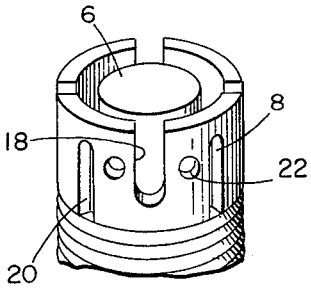
Figure 6:
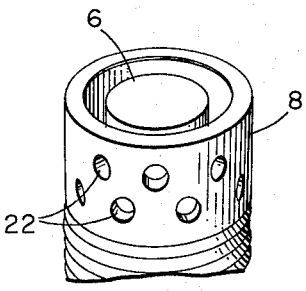
Figure 7:
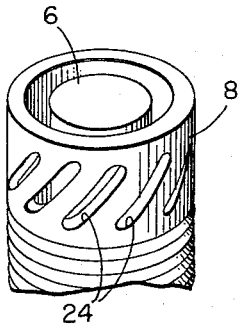

In FIG. 3 the outer electrode 8 includes a plurality of backward spaced slots 20, as well as a plurality of small holes 22 distributed between the slots 20. The holes 22 serve primarily to increase heat dissipation away from the electrodes. Various other configurations are shown in FIGS. 4–6, and include respectively the provision in the outer electrode 8 of backward spaced slots 20 only, of open ended slots 18, backward spaced slots 20, and holes 22, and of holes 22 only. In FIG. 7 is shown an embodiment in which the distribution of gas flow within the spark gap is made more uniform by the provision of slanted, backward spaced slots 24 that overlap somewhat in the axial direction of the spark plug.

Figure 8:
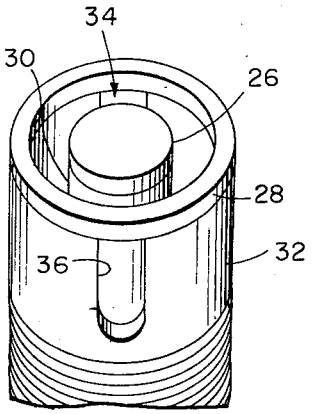

Referring now to FIG. 8, in order to conserve the fairly expensive materials involved in the present invention electrodes are provided as thin layers of electrode material 26 and 28, in the order of about 1/16 inch thick, deposited by welding to the forward ends of electrically conductive mounting bases 30 and 32, formed from an inexpensive material such as steel. The electrode mounting bases 30 and 32 are generally cylindrical and coaxial, extending forward from the spark plug body and spaced apart by a gap at least as wide as the spark gap 34 to confine the sparks to the electrodes 26 and 28. The outer mounting base 32 includes a plurality of slots 36 to provide gas flow passageways between the exterior of the mounting base and the space that lies between the mounting bases 30 and 32 and adjacent to the spark gap 34, and thereby enhance the spark path as described above.

Figure 9:
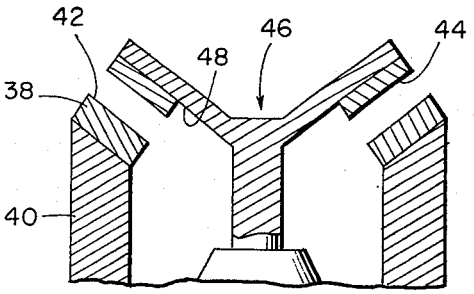
FIGS. 9 and 10 are fragmentary cross-sectional views of other electrode configurations.

Another embodiment, shown in FIG. 9, also has the advantage of economy of materials, as well as a desirable spark path and a spark gap adjustment feature. The outer electrode 38 is deposited on a hollow cylindrical mounting base 40 comprising an extension of the spark plug body and characterized by an annular shape with its forward edge 42 sloped to face inwardly toward the spark plug axis. The other electrode 44 comprises a layer of electrode material deposited on a generally conical mounting base 46, the outer side wall 48 of which is generally parallel to the sloped forward edge 42 of the electrode 38. The outer face of electrode 44, having a face of deposited electrode material, is also parallel with sloped electrode edge 42, defining a uniform spark gap therebetween. The conical mounting base 46 may be provided with means to adjust its extension forward from the spark plug, to thereby adjust the width of the spark gap. While it is preferred that both the inner mounting base 46 and the forward edge 42 of the outer electrode 38 be generally conically sloped for advantageous spark dispersion into the combustion chamber, they may also be disposed transverse to the spark plug axis.

Figure 11:
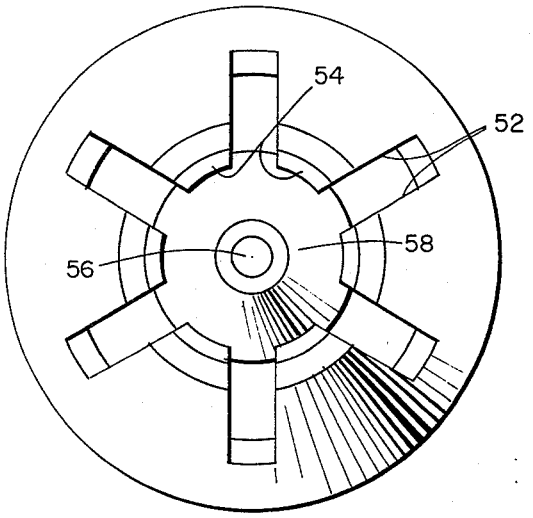
FIG. 11 is a top view of the electrode configuration shown in FIG. 10.
Figure 10:
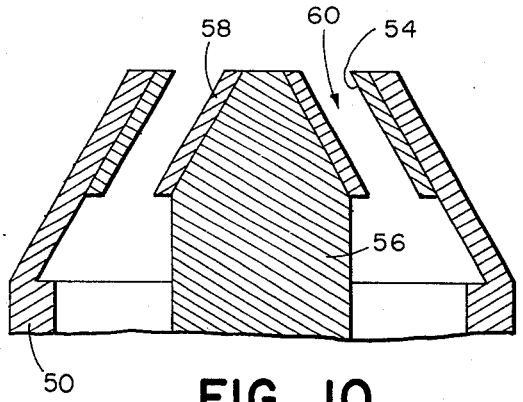

In FIGS. 10 and 11, a mounting base for an outer electrode includes an electrically conductive ring 50 and a plurality of flat, bendable fingers 52 extending generally conically inward and forward therefrom. The outer electrode comprises a thin layer 54 of electrode material, not less than 0.001 inch nor more than 0.075 inch thick and preferably within the range of 0.003 to 0.005 inch, deposited annularly on the inner finger surfaces, which are prepared by complete removal of all dirt and grease and roughened by a grit blast. A mounting base for the inner electrode includes a truncated generally conical member 56 that converges in the forward direction, the inner electrode being deposited thereon as a thin annular layer 58 opposed and parallel to the outer electrode 54. In this embodiment the width of the spark gap 60 is adjustable by bending the fingers 52. As in the embodiment of FIG. 9, a conical configuration is preferred, but the opposed electrode faces may also be disposed transverse to the spark plug axis.

In the fabrication of the above spark plugs, the metal alloys employed in the electrodes do not readily mix using conventional melt alloy methods, and grinding is very expensive. It has been found that powder metallurgy techniques may advantageously be employed in the manufacturing process by admixing the electrode materials in powdered form, compressing the admixture in high pressure presses to the desired shape, and heating the pieces to sinter the material to finished hardness and density. While these steps may be performed in sequence, by heating the mass simultaneously with the compression step, for example by passing a high current through the powder, shrinkage and non-uniformity problems encountered with the powder is first compressed and afterwards heated have been avoided. In addition, simultaneous compression and heating can be accomplished with considerably lower pressures and temperatures than required to perform the two steps separately. The completed electrodes are rigidly attached to the remainder of the spark plug, preferably by performing the above process with the electrode powders in intimate contact with the plug.

Another method that may advantageously be used, particularly for electrodes such as those of FIGS. 9–11 which are deposited as thin surface layers on mounted bases, involves the use of plasma spraying techniques. The electrode materials are mixed and introduced in powdered form into an inert gaseous plasma heated to temperature up to 30,000°F. The powder is melted and projected along with the plasma onto the desired portion of the mounting base, which becomes coated with the electrode material. In some cases the existing electrodes of conventional spark plugs may be used as mounting faces. The electrode thickness is controlled by the rate at which the powdered material is metered into the plasma spray, and by the duration of the process.

While particular embodiments of the invention have been shown and described, there are modifications thereof which will be apparent to those skilled in the art, and therefore it is not intended that the invention be limited to the disclosed embodiments or to the details thereof, and departures may be therefrom within the spirit and scope of the invention as defined in the claims.

What is claimed is:

1. A spark plug comprising a mounting body and outer and inner electrodes carried by said body extending forwardly therefrom and separated from each other by a space constituting a spark gap, said outer electrode having an inner surface of revolution opposing said inner electrode across said spark gap, said inner electrode having an outer surface parallel to the opposing surface of said outer electrode to provide a large number of alternate sparking paths through said gap;

both of said electrode surfaces being formed of an alloy consisting of 75% nickel, 15% chromium, 5% iron, and the remainder copper.

2. A spark plug as claimed in claim 1 in which said surface of revolution is cylindrical and concave.

* * * * *